United States Patent [19]

Buzzi

[11] 4,163,379

[45] Aug. 7, 1979

[54] APPARATUS FOR PERFORMING A WORKING OPERATION ON THE TIP OR POINT OF A BALL POINT PEN

[75] Inventor: Ugo Buzzi, Arzo, Switzerland

[73] Assignee: Albe S.A., Agno, Switzerland

[21] Appl. No.: 873,835

[22] Filed: Jan. 31, 1978

[30] Foreign Application Priority Data

Feb. 2, 1977 [CH] Switzerland ..... 1291/77
Nov. 29, 1977 [CH] Switzerland ..... 14634/77

[51] Int. Cl.[2] ..... B21D 19/06
[52] U.S. Cl. ..... 72/121; 72/123; 113/32 BP
[58] Field of Search ..... 113/32 BP; 72/121, 123

[56] References Cited

U.S. PATENT DOCUMENTS

| | | | |
|---|---|---|---|
| 3,132,615 | 5/1964 | Cadman | 113/32 PB |
| 3,473,358 | 10/1969 | Marcovitch | 72/121 |
| 3,815,397 | 6/1974 | Hollencamp | 72/121 |

*Primary Examiner*—Lowell A. Larson
*Attorney, Agent, or Firm*—Young & Thompson

[57] ABSTRACT

Apparatus for swaging the tips of ballpoint pens comprises three identical working rollers each having a conical running surface and a conical or otherwise rotatively contoured working surface. The conical running surfaces roll on a conical seat whose apex coincides with the axes of the three conical running surfaces of the rollers, thereby to avoid slippage.

9 Claims, 4 Drawing Figures

APPARATUS FOR PERFORMING A WORKING OPERATION ON THE TIP OR POINT OF A BALL POINT PEN

This invention relates to apparatus for performing a working operation on the tip or point of a ball point pen. The working operation may be for example, a peening operation in order to hold a ball captive in the tip or may be a flanging or re-edging operation.

Apparatus for performing working operations on the point or tips of ball pens are known and comprise a shaft carrying three very small ball bearings disposed around the shaft at 120° to one another. The axes of the bearings are inclined to the shaft axis so that the lateral surfaces of the said three ball bearings can be pressed simultaneously against the point or tip to be worked.

Such an arrangement is disclosed in Swiss Pat. No. 481,763 in the name of Albe S. A.

Such known apparatus is very suitable for performing working operations on the points of ball pens made of soft material such as brass, aluminum and other soft metals.

When, however, it is used for working points of ball pens which are made of hard material such as, for example, stainless steel, a satisfactory result is not achieved because, as a result of wear due to the strong pressure on the bearings, the positional accuracy of the axis of the bearings is lost which is detrimental to the precision of the worked point edge.

Accordingly an object of the present invention is to obviate this drawback by eliminating or reducing wear on bearing surfaces even when the apparatus operates under strong pressures.

In accordance with the invention there is provided an apparatus for performing a working operation on the tip of a ball point pen, especially a tip which is made of a hard material, such as stainless steel, comprising three similar working rollers arranged to roll without slip on a seating as a tip is being worked on the apparatus, each of said rollers having a conical or frusto-conical running surface which in use runs on the seating, which is also conical or frusto-conical, and the apex of the cone defined by the seating coinciding with the apex of each cone defined by each of the running surfaces, each of the rollers having at one end a working surface arranged so that all three working surfaces will operatively engage a ball point pen tip when operatively positioned to be worked by the apparatus by being presented along the axis of the cone defining the seating surface.

Embodiments of the present invention will now be described, by way of example, with reference to the accompanying drawings, wherein.

Figure 1:
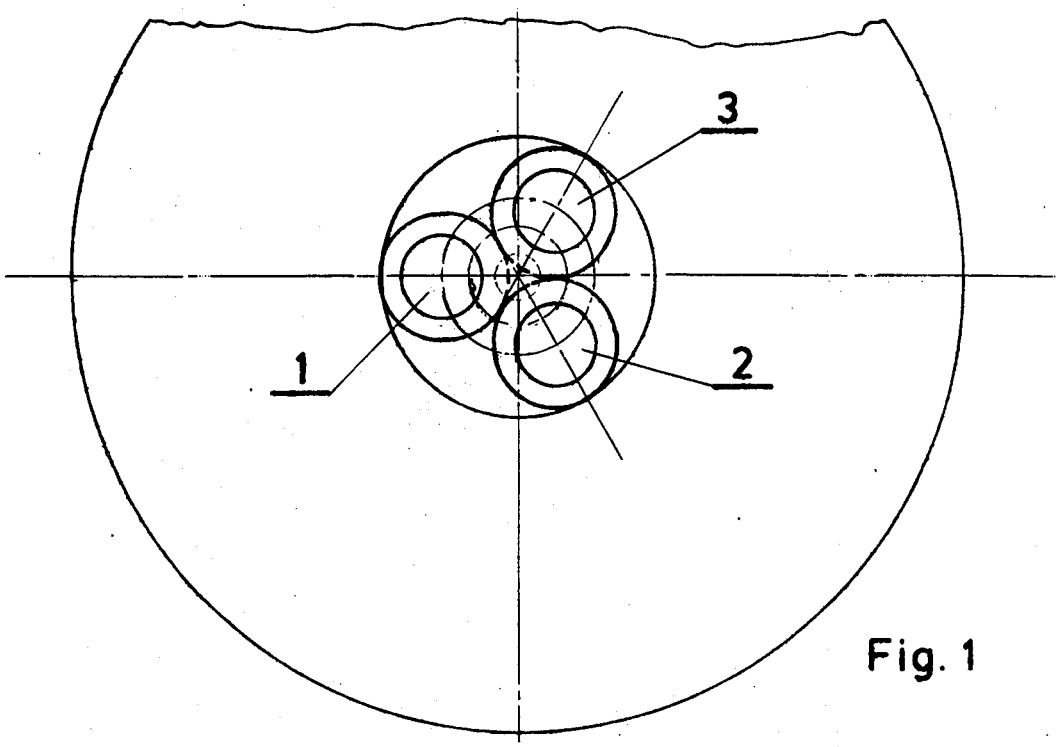
FIG. 1 shows in underneath plan, apparatus according to a first embodiment of the invention.
Figure 2:
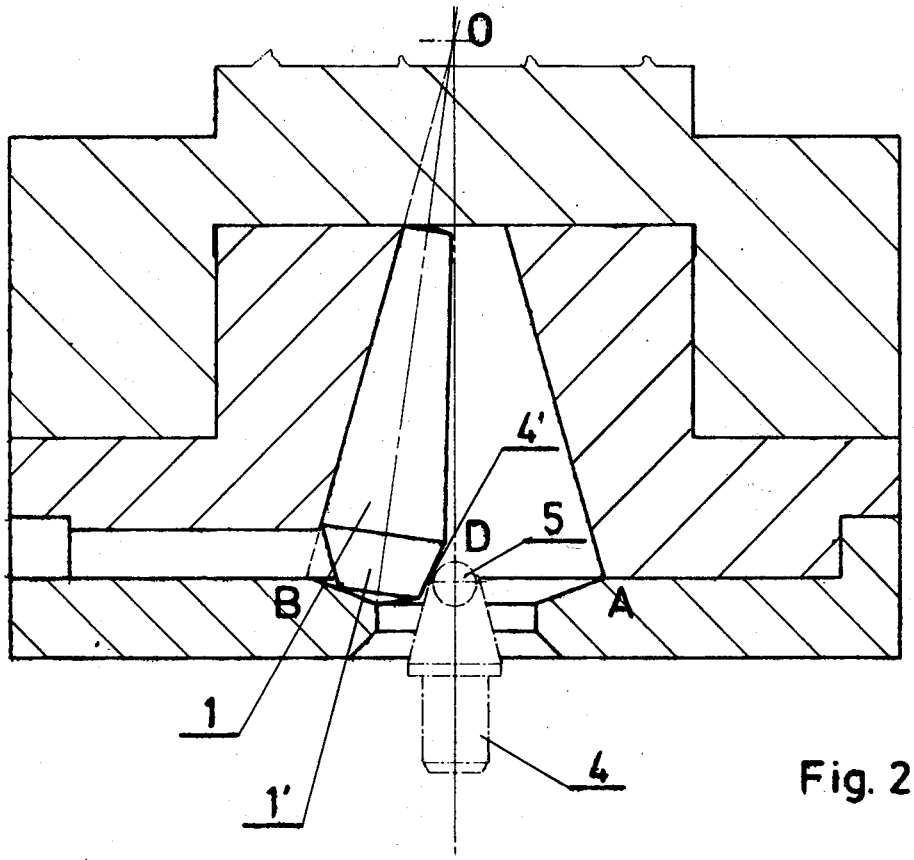
FIG. 2 is a sectional elevation of the apparatus shown in FIG. 1, but showing only one of the rollers.

The apparatus shown in FIGS. 1 and 2 comprises: three similar rollers 1, 2 and 3 of very hard steel or of other material of great hardness. Each of the rollers 1, 2 and 3 has a frusto-conical running surface 1 and the rollers are arranged so that their three axes coincide at the point O which is also the apex of a frusto-conical seating surface AOB on which the three rollers are arranged equi-angularly and are adapted to press and roll. The point 4 on which a working operation has to be performed must be presented to the apparatus as shown i.e. along the axis DO.

Each roller has at the one end, which is the bottom end in FIG. 2, a working surface 1' which presses directly on the edge 4' of the point to be worked so as to hold the ball 5 with the desired clearance. Such surface 1' is shown as being frusto-conical and of opposite inclination to that of the surface 1. In any case, the surface 1' is preferably shaped to the shape desired on the point edge.

Because of the axes of the rollers 1, 2, and 3 intersect the apex O of the cone AOB defining the seating surface on which the three rollers rotate, their rotary movement around the axis DO occurs by frictional rotation without slip.

Similarly the surface 1' which presses the edge 4' to the worked rotates on such edge without slip thus effecting a perfect working operation.

The said frusto-conical surface 1' may also be concave or otherwise shaped to conform better to the edge 4' in order to reproduce the final shape of same.

From what is set forth above, it is clear that the rollers 1, 2, 3 rest on the seating surface AOB along the whole length of their frusto-conical running surface 1 which results in that a very considerable force can be exercised on the edge 4', even if it is of very hard material, without thereby giving rise to any substantial wear of the seating surface and this enables working to a very high precision.

The three rollers 1, 2, 3 and the seating surface are made of very hard steel alloys or of sintered, hard metal.

Figure 3:
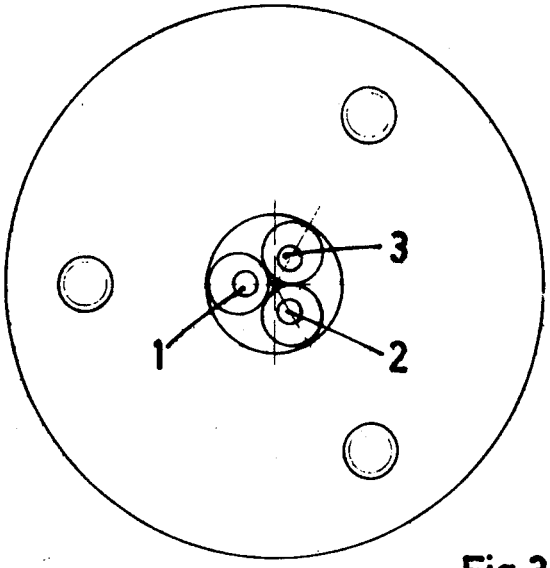
FIG. 3 shows, in underneath plan, apparatus according to a second embodiment of the invention.
Figure 4:
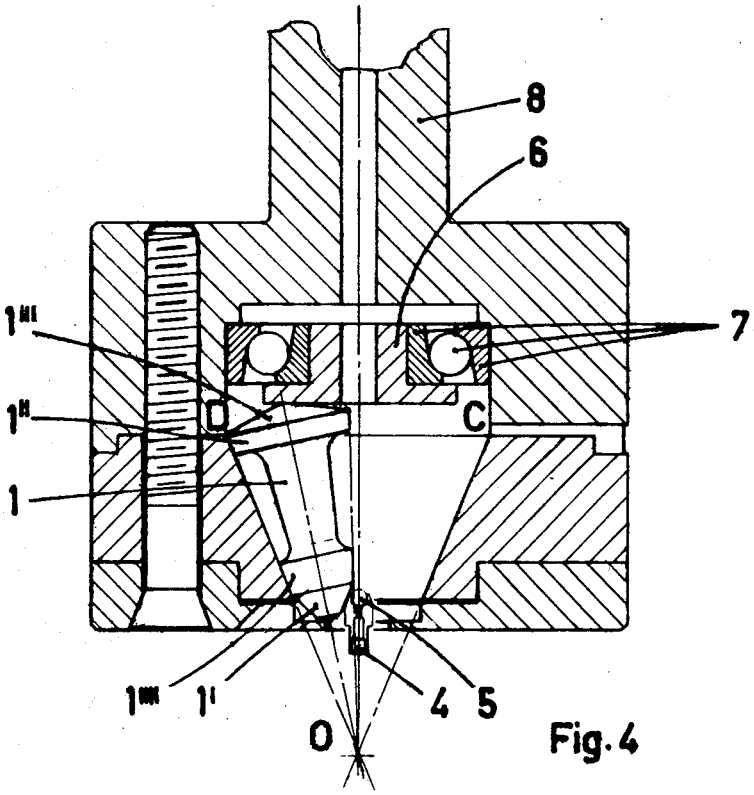
FIG. 4 is a sectional elevation of the apparatus shown in FIG. 3, but showing only one of the rollers.

In FIGS. 3 and 4 a second embodiment is shown in which the conical seating surface defined by cone COD (FIG. 4) on which the three rollers 1, 2, 3 roll without slip, is arranged to face oppositely from the manner in which it faces in the FIGS. 1 and 2 embodiment. A tail piece 8 of the apparatus which is adapted to be gripped by a mandrel (not shown) of a machine on which the apparatus is to be mounted is shown in FIG. 4.

The three rollers which press the edge of the point to be worked do so by means of their working faces 1', and run on the seating surface by means of two spaced frusto-conical running surfaces 1'', 1'''' which have the same cone angle and axis.

Each roller has a conical reaction surface 1''' which engages disc 6 rotatable about the axis of the seating surface by being carried by ball or roller bearing 7.

As follows from the comparison of the FIGS. 2 and 4 in the first case (FIG. 2) the frusto-conical seating surface is convergent towards in the direction in which points are presented in the apparatus and in the second case (FIG. 4) is divergent in the direction in which the point is presented to the apparatus.

I claim:

1. An apparatus for performing a working operation on the tip of a ball point pen, especially a tip which is made of a hard material, such as stainless steel, comprising three similar working rollers arranged to roll without slip on a seating as a tip is being worked on the apparatus, each of said rollers having a conical or frusto-conical running surface which in use runs on the seating, which is also conical or frusto-conical, and the apex of the cone defined by the seating coinciding with the apex of each cone defined by each of the running surfaces, each of the rollers having at one end a working surface arranged so that all three working surfaces will operatively engage a ball point pen tip when operatively positioned to be worked by the apparatus by being presented along the axis of the cone defining the seating surface.

2. An apparatus according to claim 1, wherein each roller has two frusto-conical running surfaces which are spaced and which have a common axis and apex.

3. An apparatus according to claim 1, wherein the seating surface and rollers are arranged so that a tip to be worked must be presented to the apparatus in a direction from the wide end to the apex of the cone defining the seating surface.

4. An apparatus according to claim 1, wherein the seating surface and rollers are arranged so that a tip to be worked must be presented to the apparatus in a direction from the apex to the wide end of the cone defining the seating surface.

5. An apparatus according to claim 1, wherein the working surface of each roller is conical or frusto-conical.

6. An apparatus according to claim 5, wherein the conical or frusto-conical working surface of each roller is of the opposite inclination to that of the or each running surface of the roller.

7. An apparatus according to claim 5, wherein the conical or frusto-conical working surface of each roller is of the same inclination but of larger cone angle than that of the or each running surface of the roller.

8. An apparatus according to claim 1, wherein each roller has a conical reaction surface at the opposite end of the roller from the working surface including a roller bearing mounted rotatable disc which is engaged by the reaction surfaces of the rollers.

9. An apparatus according to claim 1, wherein said seating surface and each of said rollers is defined by a hard material such as hardened steel or other metal.

* * * * *